United States Patent [19]

Kelley et al.

[11] Patent Number: 4,478,602

[45] Date of Patent: Oct. 23, 1984

[54] CARBONACEOUS OIL SLURRIES STABILIZED BY BINARY SURFACTANT MIXTURES

[75] Inventors: Edwin L. Kelley, Succasunna; Walter J. Herzberg, Fair Lawn; Joseph V. Sinka, Mendham, all of N.J.

[73] Assignee: Diamond Shamrock Chemicals Company, Dallas, Tex.

[21] Appl. No.: 348,238

[22] Filed: Feb. 12, 1982

[51] Int. Cl.[3] ..... C10L 1/32

[52] U.S. Cl. ..... 44/51; 44/63; 44/72; 252/357

[58] Field of Search ..... 44/51, 63, 72, 62; 252/357; 556/445

[56] References Cited

U.S. PATENT DOCUMENTS

| | | | |
|---|---|---|---|
| 2,268,273 | 12/1941 | Wilkes | 428/274 |
| 2,979,528 | 4/1961 | Lundsted | 252/110 |
| 3,637,783 | 1/1972 | Haluska | 556/445 |
| 3,669,608 | 6/1972 | Weguller | 8/573 |
| 4,069,022 | 1/1978 | Metzger | 44/51 |
| 4,147,519 | 4/1979 | Sawyer | 44/51 |
| 4,201,552 | 5/1980 | Rowell | 44/51 |
| 4,276,054 | 6/1981 | Schmolka | 44/51 |
| 4,363,637 | 12/1982 | Knitter et al. | 44/51 |
| 4,364,742 | 12/1982 | Knitter et al. | 44/51 |

FOREIGN PATENT DOCUMENTS

| | | | |
|---|---|---|---|
| 53-82808 | 7/1978 | Japan | 44/51 |
| 55-48291 | 4/1980 | Japan | 44/72 |

OTHER PUBLICATIONS

*McCutcheon's Detergents and Emulsifiers*, 1967, Witco Chemical Company, Inc., New York, N.Y., pp. 255 and 203.

*Primary Examiner*—William R. Dixon, Jr.
*Assistant Examiner*—Margaret B. Medley
*Attorney, Agent, or Firm*—Leslie G. Nunn, Jr.

[57] ABSTRACT

Binary surfactant mixtures are added to particulate carbonaceous materials in oil slurries such as coal oil (COM) or coke oil mixtures in an amount sufficient to stabilize slurries during storage and dispersing at various temperatures. These stabilizer mixtures are added to either the oil or slurry and are effective with or without addition of water. Coal/coke oil slurries may contain from about 30 to about 90 parts by weight of oil, about 10 to about 70 parts by weight of powdered coal or coke, about 0.01 to about 6.0 parts by weight of the stabilizer mixture and about 0 to about 10 parts by weight of water. A useful stabilizer mixture contains from about 0.25 to about 0.75 parts by weight of an imidazoline quaternary salt and from about 0.75 to about 0.25 parts by weight of a nonionic surfactant which is ethylene diamine condensed first with about 80 moles of propylene oxide and then with about 20 moles of ethylene oxide.

8 Claims, No Drawings

CARBONACEOUS OIL SLURRIES STABILIZED BY BINARY SURFACTANT MIXTURES

BACKGROUND OF THE INVENTION

1. Field of the Invention

This invention relates to stabilized oil slurries containing carbonaceous materials and more particularly to coal or coke in oil slurries stabilized by binary surfactant mixtures.

2. Description of the Prior Art

Addition of solid particulate carbonaceous materials, such as coal or coke, to a liquid hydrocarbon fuel, such as fuel oil, have been studied extensively. During the past five years, and particularly the last two years, the importance of reducing dependency of the world upon natural gas and liquid hydrocarbon fuels for its energy has been dramatically demonstrated.

Although incorporation of solid particulate carbonaceous material, such as coal and coke, into liquid hydrocarbon fuels, does not provide a complete solution to this energy problem, attempts have been made because particulate carbonaceous materials are more plentiful than liquid fuels. There is considerable interest in extending and/or supplementing liquid fuels with solid fuels.

Many large industrial fuel users have equipment which was designed and constructed for the transportation, storage and combustion of liquid fuels. As yet, solid-liquid slurries, suspensions or emulsions are not accepted for regular use in such conventional equipment. In some instances equipment was converted from its original design for burning solid fuels to liquid fuels. Many believe this trend should be reversed.

Various solutions to the problem of combining a solid particulate carbonaceous material with a liquid hydrocarbon fuel have been explored. One solution involved grinding carbonaceous material to colloidal size before introducing it into an oil. Even though this solution was successful, grinding costs were prohibitive. Coal oil slurries tend to form gels when heated to usable temperatures during storage, usually thixotropic gels.

Attempts were made to use the gelling phenomenon to hold larger than colloidal size particles in suspension. The gel was later broken down by adding additional oil so that the resulting slurry was pumpable without particulate material settling out. Inherently, this procedure was an expensive batch process.

Various materials were also added in attempts to stabilize a coal oil slurry against settling of larger than colloidal size coal particles. Lime-rosin and starch were added to prevent settling of the larger slurry particles. Casein, gelatin and rubber were also added as suspension stabilizing agents to inhibit settling of coal particles. It was found that these suspension stabilizing agents must be added in quantities which undesirably thicken and increase viscosity of the slurry in order to prevent substantial quantities of coal particulate material from settling. Increasing slurry viscosity not only reduced the settling problem, but also limited uses to which the slurry may be put.

U.S. Pat. No. 4,069,022—Metzger, issued Jan. 17, 1978, describes a substantially water-free, high solid content, stable and combustible fuel slurry of about 5 to about 50 weight percent of a solid particulate carbonaceous material with the balance of the slurry being a liquid hydrocarbon fuel, a slurry suspension stabilizing agent and a water-free slurry viscosity reducing agent.

The viscosity reducing agent was present in an amount sufficient to maintain the slurry at a viscosity below about 300 seconds Saybolt Universal when the slurry is at a temperature of 175° F. Preferably, the viscosity reducing agent was a soap and the suspension stabilizing agent was starch.

The process for preventing formation of a gel in and controlling the settling and viscosity of this slurry involved the step of adding to the slurry containing a suspension stabilizing agent, a soap or salt of a fatty acid in an amount sufficient to maintain the viscosity of the slurry below 300 seconds Saybolt Universal when the slurry temperature was 175° F.

U.S. Pat. No. 4,147,519—Sawyer, Jr., issued Apr. 3, 1979, describes suspensions of coal dust powder in fuel oil, a gelling grade clay and an organic cationic surfactant which is the reaction product of oleic acid and aminoethylethanolamine.

U.S. Pat. No. 4,201,552—Rowell et al, issued May 6, 1980, describes coal oil slurries stabilized with benzylalkonium chloride and stearylbenzyl dimethyl ammonium chloride.

U.S. Pat. No. 4,276,054—Schmolka et al, issued June 30, 1981, describes a suspension of solid particulate carbonaceous material in a liquid hydrocarbon containing a propoxylated, ethoxylated ethylenediamine or a propoxylated, ethoxylated propylene glycol as a stabilizer.

SUMMARY OF THE INVENTION

Binary surfactant mixtures are added to carbonaceous materials in oil slurries such as a coal oil mixture (COM) or a coke oil mixture in an amount sufficient to stabilize slurries during storage and dispersing at various temperatures. These stabilizer mixtures are added to either the oil or slurry and are effective with or without addition of water. Coal/coke oil slurries may contain from about 30 to about 90 parts by weight of oil, about 10 to about 70 parts by weight of powdered coal or coke, about 0.01 to about 6.0 parts by weight of the stabilizer mixture and about 0 to about 10 parts by weight of water.

DETAILED DESCRIPTION

Carbonaceous oil slurries may be stabilized with binary surfactant mixtures wherein the two surfactants in the mixture are selected from the following surfactants.

(A) An imidazoline quaternary salt, including 1-hydroxyalkyl 2-hydrocarbyl imidazoline quaternary salt, having the formula:

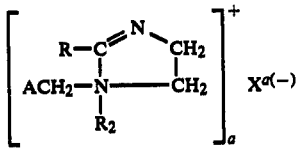

wherein:

R is hydrocarbon radical having 9 to 23 carbon atoms, A is $R_1$—OH or $CH_2NHCOR'$ where R' is an alkyl group having from 1 to 17 carbon atoms such as octyl and heptadecyl, $R_1$ is a $-CH_2-$ or $-\overset{CH_3}{\overset{|}{C}}H-$ radical, $R_2$ is hydrogen, an unsubstituted or hydroxy-substituted aliphatic hydrocarbon radical having 1 to 6 carbon atoms or a benzyl radical, X is a water-soluble anion and a is a number equal to the ionic valence of the anion, X. Compounds of this general formula may be made by quaternarizing (e.g., with a $C_1$–$C_6$ hydrocarbon or benzyl halide or sulfate) an imidazoline produced by the dehydration cyclization of (a) an amide resulting from the reaction of a $C_{10}$ to $C_{24}$ aliphatic hydrocarbonoic acid and either 2-hydroxyethyl ethylene diamine or 2-hydroxy-isopropyl ethylene diamine as described in U.S. Pat. Nos. 2,268,273 and 3,669,608 or (b) a diamide resulting from the reaction of a $C_{10}$ to $C_{24}$ aliphatic hydrocarbonic acid and diethylenetriamine.

In the imidazoline compounds used herein, the $C_9$–$C_{23}$ aliphatic hydrocarbon radical, R, may be: saturated or unsaturated; linear, branched, or cyclic; and comprised of a mixture of the $C_9$–$C_{23}$ hydrocarbons. Illustrative of acids that may be used in producing the compounds and form the hydrocarbon radical thereof are lauric, palmitic, stearic, erucic, oleic, linoleic, linolenic and tallow acids. As will be appreciated, the commercial technical grades of these and other acids, which may be used to produce the imidazoline compounds described herein, normally contain considerable minor quantities of hydrocarbons outside the $C_{10}$ to $C_{18}$ range. Therefore, the imidazoline compounds prepared from such acids may contain minor quantities of compounds having 2-hydrocarbyl groups having less than 9 carbons or more than 23 carbons.

$R_2$ is any unsubstituted or hydroxysubstituted hydrocarbon radical having 1 to 6 carbon atoms that is linear, branched, or cyclic, and either saturated or unsaturated, or may be a benzyl radical when the imidazoline compounds used are produced by quaternarization as for example, with a $C_1$–$C_6$ hydrocarbon or benzyl halide or sulfate or with an active epoxide such as ethylene or propylene oxide.

The anion, X, is not critical and may be $Cl^-$, $Br^-$, $CH_3COO^-$, $C_2H_5SO_4^-$, $CH_3SO_4^-$ or like anion. Generally preferred, because of their lower costs, are the chloride, methosulfate and ethosulfate anions.

The reaction product of oleic acid, aminoethylethanolamine and diethyl sulfate is a useful imidazoline quaternary salt.

(B) Ethylene diamine condensed first with about 80 moles of propylene oxide and then with about 20 moles of ethylene oxide. This alkylene oxide condensate of ethylene diamine may be prepared by the procedure given in U.S. Pat. No. 2,979,528—Lundsted, issued Apr. 11, 1961. This condensation product is offered commercially as Tetronic ® 1502. The commercial product has a molecular weight of 9000 and a HLB value of 5.0.

(C) Ethylene diamine condensed first with about 60 moles of propylene oxide and then with about 40 moles of ethylene oxide. This alkylene oxide condensate may be prepared by the procedure given in U.S. Pat. No. 2,979,528—Lundsted, issued Apr. 11, 1961. This condensation product is offered commercially as Tetronic 1504. The commercial product has a molecular weight of 12,500 and a HLB value of 13.0.

(D) Polypropylene glycol having a molecular weight of 4000 condensed with 30% by weight of ethylene oxide. This condensation product is offered commercially as Pluronic ® P-123.

(E) A copolymer of monoallylether of a polyalkyleneoxide and polydimethylsiloxane having the following structure:

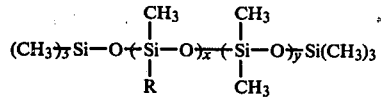

where x is an integer of from about 1 to about 30 and y is an integer of from about 5 to about 100 and the siloxane backbone (excluding R) has a molecular weight of about 500 to about 10,000 and constitutes about 10% to about 70% by weight of the total molecule. The positioning of the

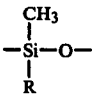

fragment is generally random.

R is

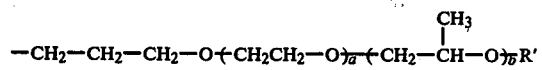

where a is an integer of from 0 to about 70, b is an integer of from 0 to about 50 and the ethylene oxide and propylene oxide fragments are present in molar ratios of 0:100 to 100:0. Where both ethylene oxide and propylene oxide fragments are present in R, their positioning can be either random or block. R has a molecular weight of about 400 to about 5,000. R′ is H or a hydroxyl blocking group. The blocking group is not critical. Thus, R′ can be for example, straight or branched chain alkyl of 1 to 20 carbon atoms such as methyl, ethyl, propyl, isopropyl, amyl, octyl, isooctyl and decyl; aromatic such as phenyl and substituted aromatic such as tolyl and acyl having from 1 to 18 carbons such as acetyl, propionyl and stearoyl.

These materials are prepared by well known reactions between allyl terminated polyethers and siloxanes containing Si—H groups. For example, this reaction can be carried out at temperatures between 85° C. to 145° C. over a platinum catalyst with a 20% excess of polyether. Optionally, this reaction can be carried out in the presence of a solvent such as xylene.

The siloxane which contains Si—H groups is prepared by equilibrating a mixture of hydrogen methyl polysiloxane of approximately 5,000 molecular weight, hexamethyldisiloxane and octamethylcyclotetrasiloxane (cyclic tetramer of dimethylsiloxane) in a mole ratio which depends on the desired values of x and y. Equilibration is carried out at room temperature using trifluoromethanesulfonic acid as catalyst.

Specific examples are where:

A.

1. The siloxane backbone has a molecular weight of 1,000; x=3 and y=11.
2. R has a molecular weight of 500.
3. R consists of ethylene oxide moieties only.
4. The siloxane backbone constitutes 60% by weight of the total molecule.
5. R′ is acetyl.

B

1. The siloxane backbone has a molecular weight of 1,000; x=3 and y=11.

2. R has a molecular weight of 1,200.
3. The ethylene oxide and propylene oxide fragments are present in a molar ratio of 1:1.
4. The ethylene oxide/propylene oxide fragment is a random copolymer.
5. The siloxane backbone constitutes 20% by weight of the total molecule.
6. R′ is hydrogen.

C

1. The siloxane backbone has a molecular weight of 1,000; x=3 and y=11.
2. R has a molecular weight of 1,200.
3. The ethylene oxide and propylene oxide fragments are present in a molar ratio of 1:3.
4. The ethylene oxide/propylene oxide fragment is a random copolymer.
5. The siloxane backbone constitutes 20% by weight of the total molecule.
6. R′ is hydrogen.

D

1. The siloxane backbone has a molecular weight of 3,000; x=6; y=36.
2. R has a molecular weight of 1,800.
3. The ethylene oxide and propylene oxide fragments are present in a molar ratio of 1:1.
4. The ethylene oxide/propylene oxide fragment is a random copolymer.
5. The siloxane backbone constitutes 20% by weight of the total molecule.
6. R′ is H.

E

1. The siloxane backbone has a molecular weight of 5,000; x=15; y=55.
2. R has a molecular weight of 1,200.
3. The ethylene oxide and propylene oxide fragments are present in a molar ratio of 1:1.
4. The ethylene oxide/propylene oxide fragment is a random copolymer.
5. The siloxane backbone constitutes 20% by weight of the total molecule.
6. R′ is H.

F

1. The siloxane backbone has a molecular weight of 1,000; x=3; y=11.
2. R has a molecular weight of 1,200.
3. The ethylene oxide and propylene oxide fragments are present in a molar ratio of 1:1.
4. The ethylene oxide/propylene oxide fragment is a block copolymer.
5. The siloxane backbone constitutes 20% by weight of the total molecule.
6. R is hydrogen.

In the above examples the molecular weight of the siloxane backbone excludes the molecular weight of R.

F

Quaternary salt of an amine having the following structure:

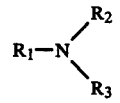

wherein $R_1$ is an alkyl group containing from 12 to 22 carbon atoms, $R_2$ and $R_3$ are H, methyl, ethyl or propyl and $R_2$ and $R_3$ can be the same or different.

Examples of $R_1$ are lauryl, myristyl, palmityl and stearyl. Useful quaternizing agents are dimethylsulfate, diethyl sulfate, methyl chloride, benzyl chloride, etc. Examples of the foregoing are the diethyl sulfate quaternary salt of $C_{16}$ dimethyl tertiary amine and the benzyl chloride quaternary salt of $C_{12}$ dimethyl tertiary amine. Lauryl benzyl dimethylammonium chloride is a useful quaternary salt of a tertiary amine.

The term "carbonaceous", as used herein, encompasses solid particulate carbonaceous fossil fuel materials which have been powdered or pulverized to a size where 80% or more will pass through a 200 mesh screen. Useful carbonaceous materials include bituminous and anthracite coals, coke, petroleum coke, lignite, charcoal, peat, admixtures thereof and the like. Further details relating to these materials, oils and carbonaceous oil slurries may be found in U.S. Pat. No. 4,069,022—Metzger, issued Jan. 17, 1978.

Oils suitable for these slurries include fuel oils such as No. 6 fuel oil, No. 2 fuel oil as well as other liquid petroleum products such as gas oils and crude oils used as fuel oils or the like.

Powdered coal used used in these slurries may be pulverized bituminous, anthracite, or semi-bituminous coal. If desired, finely-divided solid carbonaceous materials such as powdered coke from coal or petroleum may be used in these slurries.

At room temperature, when a uniformly mixed coal oil slurry or coke oil slurry is prepared, the viscous fuel oil usually holds powdered coal in suspension. Later, when the coal oil slurry is heated so that the slurry can be pumped, the oil viscosity decreases and coal particles tend to settle. The quantity of dispersant added initially to the coal oil slurry should be sufficient to keep the coal particles suspended at elevated temperatures. To test the stabilizing effect of binary surfactant mixture, coal oil mixtures are prepared and then heat aged. The following laboratory procedure is useful in the evaluation of these coal oil and coke oil slurries with binary surfactant mixtures as stabilizers.

LABORATORY PROCEDURE FOR TESTING COAL/OIL MIXTURE (COM) STABILIZERS

I

Preparation of a Coal/Oil Slurry

A 5 gallon pail of No. 6 fuel oil was heated in an oven to a pourable viscosity. When pourable (at approximately 60°–70° C.), 2,040 grams of the oil was weighed into a wide mouth plastic jar. The oil was agitated with an open gate paddle mixer. Next, 900 grams of coal which had been pulverized to 80% through a 200-mesh screen, was slowly added to the oil. If added too quickly, the powdered coal flew out. After all of the coal was added, the mixture was stirred 10–15 minutes to assure uniformity. The slurry was then poured into 4-ounce glass jars, 98.0 grams per jar. Water (2.0% by weight) was added later, as described below. Prior to water addition, the coal/oil slurry contained 30.612% coal; after adding 2% water, the coal content was 30.0% of the coal/oil/water system.

II

Coal/Oil Mixture (COM) Stabilizer Candidate Screening

All tests were run with 2.0% water, since it was determined that this percentage gave better stability to the coal/oil mixtures than those mixtures without water. To the 4-ounce glass jar containing 98.0 grams of coal/oil, 2.0 grams of tap water was added. Next, the desired level of stabilizer candidate, the binary surfactant mixture (0.50%, 0.25%, 0.10% by weight) was added.

The jar was then tightly capped and heated in an oven at 70° C. until the oil was slightly fluid (about 1 to 1.5 hours). The jar containing the sample was then removed from the oven and shaken to thoroughly disperse the stabilizer. In order to be sure there was no sediment on the bottom, the slurry was stirred with a spatula. The jar was then snugly capped again and placed back in the oven at 70° C. for four (4) week longevity testing. At one week intervals, the sample was removed from the oven and checked for a sedimentation deposit.

To check for a sedimentation deposit, the following basic materials were used; a glass rod preferably about 3/16 in. diameter, an indelible ink pen and a ruler. After the first week, the sample to be checked for sedimentation was removed from the oven. The glass rod was slowly inserted into the coal/oil mixture, and swung back and forth in slow short arcs, close to the side of the jar. When the level of density increased, a mark was made on the rod with the pen. The rod was then inserted to the bottom of the jar and another mark was made. To check for firmness of pack on the bottom of the jar (i.e., soft, semi-firm, firm), the rod was pushed along the bottom toward the center for a distance of about ½ inch. When the deposit was soft, the rod moved easily, with no resistance; semi-firm when there was some resistance and the slurry clung to the rod without falling away when it was withdrawn; and firm when the rod did not move. When the rod was withdrawn from the slurry, it was wiped off and measured with a ruler to determine the depth of the deposit. The marks were cleaned off the rod with acetone. The procedure was repeated for as many jars as required to be tested. The jars were securely capped again and placed back in the oven. This test procedure was carried out for four (4) consecutive weeks, taking readings once a week.

III

Numerical Rating System

Results obtained in II, above, were translated into the numerical rating system given below to facilitate treatment of the data:

| COM: Numerical Rating System* | | | |
|---|---|---|---|
| No. | Description | No. | Description |
| 0 | 1" firm | 16 | 1" soft |
| 1 | ⅞" firm | 17 | ⅞" soft |
| 2 | ¾" firm | 18 | ¾" soft |
| 3 | ⅝" firm | 19 | ⅝" soft |
| 4 | ½" firm | 20 | ½" soft |
| 5 | ⅜" firm | 21 | ⅜" soft |
| 6 | ¼" firm | 22 | ¼" soft |
| 7 | ⅛" firm | 23 | ⅛" soft |
| 8 | 1" semi-firm | 24 | minor deposit (soft) |

-continued

| COM: Numerical Rating System* | | | |
|---|---|---|---|
| No. | Description | No. | Description |
| 9 | ⅞" semi-firm | 25 | no sedimentation |
| 10 | ¾" semi-firm | | |
| 11 | ⅝" semi-firm | | |
| 12 | ½" semi-firm | | |
| 13 | ⅜" semi-firm | | |
| 14 | ¼" semi-firm | | |
| 15 | ⅛" semi-firm | | |

*This rating system is not perfect. Imperfections lie at the interfaces between firm/semi-firm and semi-firm/soft. However, the best systems have the highest numbers; the worst systems have the lowest numbers. Sorting of the data is greatly facilitated and the numbers can be presented graphically, if desired. The highest possible 4 week rating would be 100 and the lowest possible 4 weeks rating would be 0.

Binary surfactant mixtures may be prepared using Surfactants A through F described herein. The following binary surfactant mixtures may be prepared by simple mixing using 0, 25, 50, 75 or 100% of first named surfactant with the balance being the latter named surfactant and evaluated in the Laboratory Procedure for Testing Coal/Oil Mixture (COM) Stabilizers:

| Binary Mixtures of |
|---|
| A + B |
| B + C |
| B + D |
| B + E |
| A + E |
| A + F |

For a fuller understanding of the nature and advantages of this invention, reference may be made to the following examples. These examples are given merely to illustrate the invention and are not to be construed in a limiting sense. All quantities, proportions and percentages are by weight and all references to temperature are °C. unless otherwise indicated.

EXAMPLE I

Binary surfactant mixtures containing Surfactants A through F, which are described below, were prepared by mixing 0, 25, 50, 75 or 100% by weight of the first named surfactant with the balance in the mixture being the latter named surfactant:

Surfactant A was an imidazoline quaternary salt, which was the reaction product of oleic acid, aminoethylethanolamine and diethyl sulfate.

Surfactant B was a nonionic surfactant, which was the condensation product of one mole of ethylene diamine with 80 moles of propylene oxide and then with 20 moles of ethylene oxide.

Surfactant C was a nonionic surfactant which was the condensation product of one mole of ethylene diamine with 60 moles of propylene oxide and then with 40 moles of ethylene oxide.

Surfactant D was a nonionic surfactant which was the condensation product of polypropylene glycol with 30% by weight of ethylene oxide.

Surfactant E was a copolymer of monoallyl ether of a polyalkylene oxide (MW 1200) and polydimethylsiloxane (MW 1000).

Surfactant F was a quaternary salt of tertiary amine which was the reaction product of laurylamine with benzyl chloride and methyl chloride.

The following binary surfactant mixtures were prepared and tested as stabilizers using the Laboratory Procedure for Testing Coal/Oil Mixture (COM) Stabilizers described above. Surfactant concentrations of 0.25% and 0.15% by weight were used in these tests. Compositions of binary surfactant mixtures are shown below, for example, as % A in A+B where A is the first named surfactant and B is the latter named surfactant. The Numerical Rating is the total of four readings taken once a week for four consecutive weeks. The best systems have the highest numbers and the worst systems the lowest numbers. Effective concentration range of A/A+B is the concentration range which shows superior results when A is the first named surfactant and B is the latter named surfactant.

| | Numerical Rating |
|---|---|
| Surfactant Concentration = 0.25% | |
| % A in A + B | |
| 0 | 31 |
| 25 | 40 |
| 50 | 51 |
| 75 | 40 |
| 100 | 28 |
| Effective concentration range of A/A + B = 0.25 – 0.75. | |
| % B in B + C | |
| 0 | 0 |
| 50 | 8 |
| 75 | 71 |
| 100 | 31 |
| Effective concentration range of B/B + C = 0.50 – 0.90. | |
| % B in B + D | |
| 0 | 0 |
| 50 | 32 |
| 75 | 65 |
| 100 | 31 |
| Effective concentration range of B/B + D = 0.30 – 0.90. | |
| % B in B + E | |
| 0 | 22 |
| 50 | 50 |
| 75 | 12 |
| 100 | 31 |
| Effective concentration range of B/B + E = 0.30 – 0.60. | |
| % A in A + E | |
| 0 | 22 |
| 50 | 65 |
| 75 | 20 |
| 100 | 28 |
| Effective concentration range of A in A + E = 0.30 – 0.60. | |
| % A in A + F | |
| 0 | 10 |
| 50 | 63 |
| 75 | 46 |
| 100 | 28 |
| Effective concentration range of A in A + F = 0.25 – 0.75. | |
| Surfactant Concentration = 0.15% | |
| % B in B + E | |
| 0 | 55 |
| 50 | 71 |
| 75 | 53 |
| 100 | 54 |
| Effective concentration range of B in B + E = 0.25 – 0.65. | |

The above data show stabilization of oil slurries containing particulate carbonaceous materials with from about 0.15% to about 0.25% by weight binary surfactant mixture based on slurry weight. Quantities of binary surfactant mixtures employed in oil slurries of carbonaceous materials will vary depending on the types of oil and carbonaceous materials employed as well as processing conditions. It is to be understood that effective amounts of these surfactant mixtures sufficient to stabilize oil slurries of carbonaceous materials outside these limits are also included.

While the invention has been described with reference to certain specific embodiments thereof, it is understood that it is not to be so limited since alterations and changes may be made therein which are within the full and intended scope of the appended claims.

What is claimed is:

1. An oil slurry of particulate carbonaceous material stabilized with an effective amount of a binary surfactant mixture using (A), (B) and (F) surfactants where (A) is an imidazoline quaternary salt of the structure:

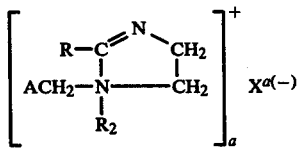

wherein:

R is a hydrocarbon radical having 9 to 23 carbon atoms, A is $R_1OH$ or $CH_2NHCOR'$ where R' is an alkyl group having from 1 to 17 carbon atoms, $R_1$ is a $-CH_2-$ or $-\overset{CH_3}{\overset{|}{C}}H-$ radical, $R_2$ is hydrogen, an unsubstituted or hydroxy-substituted aliphatic hydrocarbon radical having 1 to 6 carbon atoms or a benzyl radical, X is a water-soluble anion, and a is a number equal to the ionic valence of the anion, X, (B) is a condensation product of one mole of ethylene diamine with about 80 moles of propylene oxide and then with about 20 moles of ethylene oxide, and (F) is a quaternary salt of an amine having the following structure:

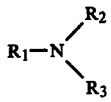

where $R_1$ is an alkyl group containing from 12 to 22 carbon atoms and $R_2$ and $R_3$ are H, methyl, ethyl or propyl and $R_2$ and $R_3$ can be the same or different, selected from the group consisting of:

(i) from about 0.25 to about 0.75 parts by weight of (A) to about 0.75 to about 0.25 parts by weight of (B) and (ii) from about 0.25 to about 0.75 parts by weight of (A) to about 0.75 to about 0.25 parts by weight of (F).

2. The slurry of claim 1 wherein there is present from about 30 to about 90 parts by weight of oil, about 10 to about 70 parts by weight of particulate carbonaceous material, about 0 to about 10 parts by weight of water and about 0.01 to about 6 parts by weight of the binary surfactant.

3. The slurry of claim 1 wherein powdered coal is present.

4. The slurry of claim 1 wherein powdered coke is present.

5. The slurry of claim 1 wherein (A) the imidazoline quaternary salt is the reaction product of oleic acid, aminoethylethanolamine and diethylsulfate.

6. The slurry of claim 1 stabilized with binary surfactant mixture (i).

7. The slurry of claim 1 stabilized with binary surfactant mixture (ii).

8. The process of producing the slurry of claim 1 comprising adding at from about 55° to about 70° C. the binary surfactant mixture to a carbonaceous oil slurry in an amount sufficient to stabilize the slurry at elevated temperatures.

* * * * *